US011083253B2

(12) United States Patent
Xu

(10) Patent No.: US 11,083,253 B2
(45) Date of Patent: Aug. 10, 2021

(54) ZIPPER WITH INCLINED SURFACE TEETH

(71) Applicant: KEE (GUANGDONG) GARMENT ACCESSORIES LTD., Guangdong (CN)

(72) Inventor: Xipeng Xu, Guangdong (CN)

(73) Assignee: KEE (GUANGDONG) GARMENT ACCESSORIES LTD., Guangdong (CN)

( * ) Notice: Subject to any disclaimer, the term of this patent is extended or adjusted under 35 U.S.C. 154(b) by 10 days.

(21) Appl. No.: 15/301,766

(22) PCT Filed: May 14, 2014

(86) PCT No.: PCT/CN2014/077482
§ 371 (c)(1),
(2) Date: Oct. 4, 2016

(87) PCT Pub. No.: WO2015/149422
PCT Pub. Date: Oct. 8, 2015

(65) Prior Publication Data

US 2017/0027288 A1 Feb. 2, 2017

(30) Foreign Application Priority Data

Apr. 4, 2014 (CN) ..... 201410135215.4

(51) Int. Cl.
*A44B 19/06* (2006.01)
*A44B 19/26* (2006.01)

(52) U.S. Cl.
CPC ..... *A44B 19/06* (2013.01); *A44B 19/262* (2013.01)

(58) Field of Classification Search
CPC ..... A44B 19/06; A44B 19/262; A44B 19/32; A44B 19/02; Y10T 24/2543; Y10T 24/2552
See application file for complete search history.

(56) References Cited

U.S. PATENT DOCUMENTS 3,591,914 A * 7/1971 Heimberger ..... B29D 5/00 29/408
8,539,650 B2 * 9/2013 Kojima ..... A44B 19/00 24/410
9,259,061 B2 * 2/2016 Kojima ..... B29C 45/0013
9,301,579 B2 * 4/2016 Fujii ..... A44B 19/02
(Continued)

*Primary Examiner* — Victor D Batson
*Assistant Examiner* — Matthew J Sullivan

(57) ABSTRACT

A zipper with inclined surface teeth includes a pair of zipper cloth tapes extending along an axial direction and left and right zipper teeth which are arranged on inners ides of the pair of zipper cloth tapes and can be mutually fastened, an outer combined lateral surface and an inner combined lateral surface being formed after the left and right zipper teeth are fastened, wherein from a cross section, the whole outer combined lateral surface forms a smoothly-transitioned inclined surface. When the zipper is in a fastened state, the whole outer combined lateral surface forms a smoothly-transitioned inclined surface, so that uneven areas of the outer combined lateral surface of the zipper teeth of the zipper are greatly reduced, the overall appearance of the outer combined lateral surface is optimized, and moreover, the user feels relatively smooth when touching the zipper teeth, and scratches to the hands are avoided.

14 Claims, 5 Drawing Sheets

(56) References Cited

U.S. PATENT DOCUMENTS

2006/0260104 A1* 11/2006 Himi ..... A44B 19/06
24/403
2007/0277354 A1* 12/2007 Jung ..... A44B 19/262
24/429

* cited by examiner

ZIPPER WITH INCLINED SURFACE TEETH

FIELD OF THE INVENTION

The invention relates to a zipper, and in particular to a zipper with inclined surface teeth.

BACKGROUND OF THE INVENTION

Using a zipper as a fastener of a textile such as a garment is a technology which has been known by the public. In general, a zipper is sewn to two side edges of an opening part of a textile, and in order to conveniently close or open the opening part, zipper teeth which can be mutually fastened are often arranged on inner sides of a left zipper cloth tape and right zipper cloth tape of the zipper respectively. The zipper teeth are provided with connecting parts connected with the zipper cloth tapes and fastening parts mutually fastened with the left and right zipper teeth, the connecting parts and fastening parts of the zipper teeth are combined into combined parts, and the combined parts are provided with outer combined lateral surfaces and inner combined lateral surfaces. In the pursuit of specificity in individual shape, outer surfaces of zipper teeth of an existing zipper always consist of many small irregularly-shaped planes, so that at least outer combined lateral surfaces of combined parts are uneven. For example, a corn tooth injection zipper disclosed in a Chinese utility model patent which is named as "corn tooth injection zipper" and applied for on Dec. 20, 2012 with a patent number 201220709200.0 in an existing technology includes a plurality of zipper teeth which are continuously and fixedly arranged on zipper cloth tapes and separation parts for combining or separating the zipper teeth; each zipper tooth includes a corn tooth-shaped structure and an ordinary tooth-shaped structure, which are integrally formed; the ordinary tooth-shaped structures and the corn tooth-shaped structures correspond to inner and outer surfaces of the zipper cloth tapes respectively; after the zipper teeth of the zipper are combined, outer lateral surfaces of its corn tooth-shaped structures also form outer lateral surfaces of combined parts, and each corn tooth-shaped structure includes a corn tooth-shaped body and a corn tooth-shaped tooth head arranged at one end of the corn tooth-shaped body; and top surfaces of the corn tooth-shaped tooth heads are arranged to be cambered structures, top end faces of the corn tooth-shaped bodies are arranged to be arched, and then after the zipper is fastened, its upper surface presents a large number of uneven areas.

SUMMARY OF THE INVENTION

Outer lateral surfaces of combined parts of zipper teeth in the existing technology generally present a large number of uneven areas, and a person may obviously feel rough at first when touching the parts and particularly sliding a zipper along an axial direction of the zipper. The outer surfaces of the combined parts are usually arranged outside a garment, so that a large number of such rough uneven surfaces look messy in use, and particularly when the zipper is used for a children garment or sportswear, hands of a child or hands of a sportsman rapidly pulling the zipper are easily scratched.

In order to solve the problem in the existing technology, one of purposes of the invention is to provide a zipper with inclined surface teeth and relatively smooth outer lateral surfaces, which includes a pair of zipper cloth tapes extending along an axial direction and left and right zipper teeth which are arranged on inner sides of the pair of zipper cloth tapes and can be mutually fastened, an outer combined lateral surface and an inner combined lateral surface being formed after the left and right zipper teeth are fastened, wherein from a cross section, the whole outer combined lateral surface forms a smoothly-transitioned inclined surface.

Wherein, the axial direction is a length extending direction of the zipper cloth tapes or the zipper.

Wherein, after the zipper cloth tapes are sewn with a garment, the sides, facing the outer side, of the zipper teeth of the zipper form the outer combined lateral surface, and on the contrary, lateral surfaces hidden in the garment form the inner combined lateral surface of the zipper teeth of the zipper.

Wherein, seeing from the cross section defines a view orientation. The cross section can be understood as a profile chart presented by seeing the zipper from front along the axial direction after the zipper is sectioned along a direction perpendicular to the axial direction, so that a sectional view is actually the profile chart of the zipper.

Wherein, from the cross section, after the left zipper teeth and the right zipper teeth are fastened, outer lateral surfaces of the left zipper teeth and outer lateral surfaces of the right zipper teeth form the outer combined lateral surface together. Specifically, the outer combined lateral surface at least includes outer lateral surfaces of connecting parts of the left and right zipper teeth, and if the left and right zipper teeth are further provided with mutually inserted tooth parts, the outer combined lateral surface further includes outer lateral surfaces of the tooth parts. From the sectional view, the outer lateral surfaces of the tooth parts of front and back adjacent zipper teeth can also be substantially overlapped.

Wherein, the whole outer combined lateral surface forms a smoothly-transitioned inclined surface, which can be understood like that the outer combined lateral surface is a smooth combined surface forming a certain included angle with a plane where the zipper cloth tapes are located and at least is not generally a plane parallel to the plane where the zipper cloth belts are located. Undoubtedly, the whole outer combined lateral surface of the zipper teeth forms the smoothly-transitioned inclined surface without hindrance to a process chamfer or process fillet to be formed at a corner part of each independent zipper tooth during the forming and manufacturing of the independent zipper tooth. Thus, if the position of the cross section is right at the process chamfer or process fillet, it may appear the problem that an outside contour line at the position cannot be overlapped with an contour line of an outside cambered surface of the whole zipper, but such a problem is an inevitable process problem during the practical manufacturing of the zipper teeth.

Compared with the existing technology, the invention has beneficial effects as follows:

when the zipper is in a fastened state, the whole outer combined lateral surface forms a smoothly-transitioned inclined surface, so that uneven areas of the outer combined lateral surface of the zipper teeth of the zipper are greatly reduced, the overall appearance of the outer combined lateral surface is optimized, and moreover, the user feels relatively smooth when touching the zipper teeth, and scratches to the hands are avoided; and in addition, when the zipper is used for a garment, particularly a high-end garment, the probability of damaging the garment by corners of the zipper teeth is greatly reduced.

The whole outer combined lateral surface forms a smoothly-transitioned inclined surface, and can be formed by multiple structures, for example:

First: the outer combined lateral surface is a cambered surface.

A further technical solution may be as follows: cambered transition points of the outer combined lateral surface are at a central axis between the left and right zipper teeth.

Wherein, the central axis is a middle line between the left and right zipper teeth after the left and right zipper teeth are fastened. When the cambered transition points of the outer combined lateral surface are at the central axis, the outer combined lateral surface is a cambered surface taking a central axis as a symmetry axis, that is, the middle of the outer combined lateral surface is high while the two sides are low or the middle of the outer combined lateral surface is low while the two sides are high.

Or, when there are no mutually inserted tooth parts on the outer sides of the left zipper teeth and the right zipper teeth, the further technical solution may also be as follows: the cambered transition points of the outer combined lateral surface are at positions where top ends of the left zipper teeth or the right zipper teeth are located. However, under such a condition, the mutually inserted tooth parts are still arranged on the inner sides of the left and right zipper teeth so as to enable the left and right zipper teeth to be fastened.

Second: a difference with the first is that the outer combined lateral surface is a herringbone combined surface, and a smooth transition is formed between inclined surfaces on the two sides. That is, the inclined surfaces on the two sides are connected through a fillet transition.

Third: the outer combined surface is provided with a platform part, and the platform part is in smooth transition with the two side edges. In such a manner, the platform part is actually a cambered transition area of the outer combined lateral surface. The platform part can be positioned in a central area of the outer combined lateral surface, and can also be slightly biased.

A further technical solution may be as follows: the whole inner combined lateral surface forms a smoothly-transitioned inclined surface, a platform part is arranged in a central area of the inner combined lateral surface, and the platform part forms smooth transitions with the inclined surfaces on the two sides.

In order to reduce frictional resistance between a puller and the zipper teeth to enable the puller to be smoothly pulled to and fro on the zipper, a further technical solution is as follows: the zipper further includes the puller for unfastening and fastening the left and right zipper teeth, wherein the puller includes an upper cover plate, a lower cover plate and a middle connecting column; side slots through which the zipper teeth pass, a zipper tooth inlet and a zipper tooth outlet are formed between the upper cover plate and the lower cover plate; zipper tooth inlet end parts are arranged at the front end of the puller, and zipper tooth outlet end parts are arranged at its tail end; and the zipper tooth inlet end part of the upper cover plate has an inner lateral surface adapted to the outer combined lateral surface. The further technical solution may also be as follows: the zipper tooth inlet end part of the lower cover plate has an inner lateral surface adapted to the inner combined lateral surface.

Wherein, the zipper tooth inlet end parts of the upper cover plate and the lower cover plate have the inner lateral surfaces adapted to the outer combined lateral surface and the inner combined lateral surface, so that the inner lateral surfaces of the zipper tooth inlet end parts are smoothly-transitioned inclined surfaces, and other inner lateral surfaces may also be smoothly-transitioned inclined surfaces.

Due to the abovementioned characteristics and advantages, the invention can be applied to various zipper products.

DETAILED DESCRIPTION OF THE PREFERRED EMBODIMENTS

The specific implementation modes of the invention are further described below with reference to the drawings.

Figure 1:
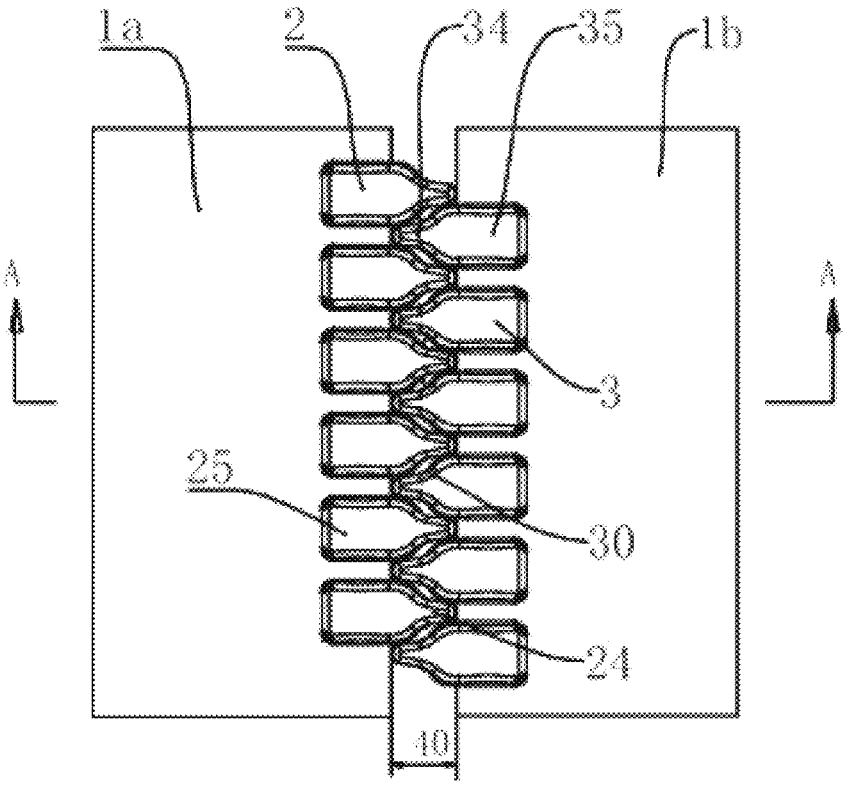
FIG. 1 is a structure diagram of a zipper with inclined surface teeth employing the technical solution of the invention when being seen from front.

FIG. 1 is a structure diagram of a zipper with inclined surface teeth employing the technical solution of the invention when being seen from front, and as shown in FIG. 1, the zipper with the inclined surface teeth includes a pair of zipper cloth tapes (1*a*, 1*b*) extending along an axial direction and left zipper teeth 2 and right zipper teeth 3 which are arranged on inner sides of the pair of zipper cloth tapes (1*a*, 1*b*) and can be mutually fastened. Wherein, the axial direction is a length extending direction of the zipper cloth tapes (1*a*, 1*b*) or the zipper; and the sides, sewn with a garment, of the zipper cloth tapes (1*a*, 1*b*) are outer sides, and the opposite sides are the inner sides of the zipper cloth tapes (1*a*, 1*b*). An outer combined lateral surface 4 and an inner combined lateral surface 5 are formed after the left zipper teeth 2 and the right zipper teeth 3 are fastened; from a cross section, as shown in FIG. 4 to FIG. 9, the whole outer combined lateral surface 4 forms a smoothly-transitioned inclined surface; and of course as shown in FIG. 10, from the cross section, the whole inner combined lateral surface 5 may also form a smoothly-transitioned inclined surface.

Figure 2:
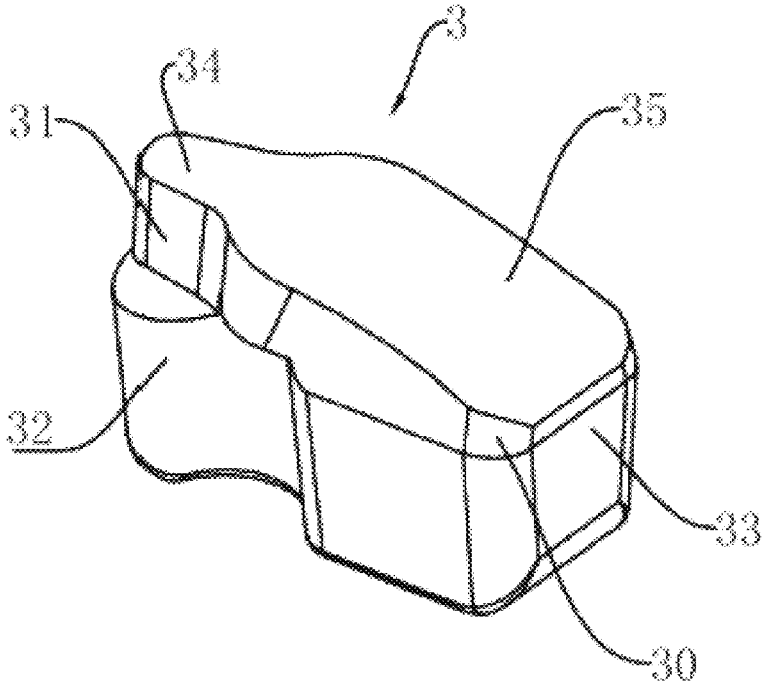
FIG. 2 is a three-dimensional structure diagram of a zipper tooth 3 applied to a zipper shown in FIG. 1.
Figure 3:
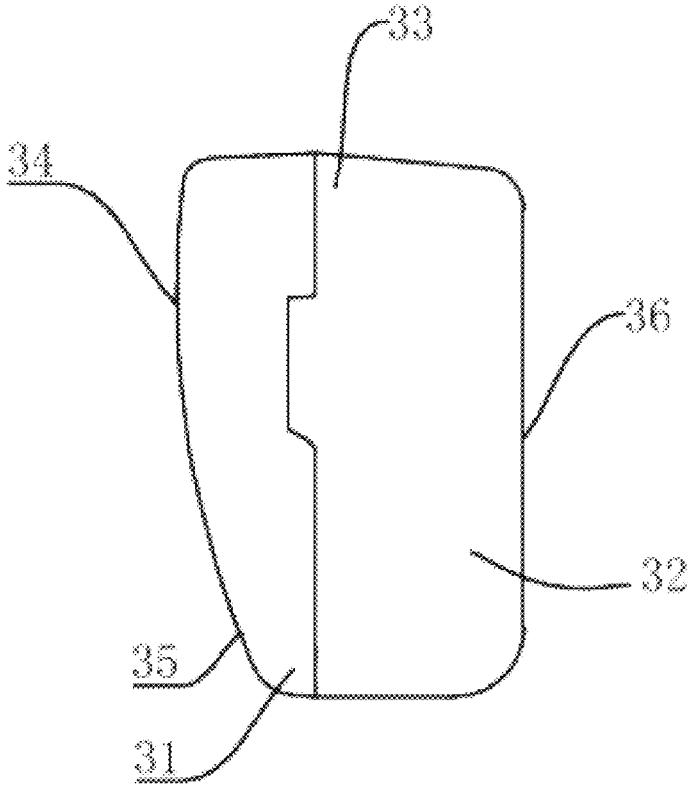
FIG. 3 is a structure diagram of a zipper tooth 3 laterally seen.

FIG. 2 is a three-dimensional structure diagram of a zipper tooth 3 applied to a zipper shown in FIG. 1, and the example is the three-dimensional structure diagram of the right zipper tooth 3. In the embodiment, structures and technical effects of the left zipper teeth 2 and the right zipper teeth 3 are similar, so that the right zipper tooth 3 is taken as an example for detailed description (but as a special example, appearance structures of the left zipper teeth 2 and the right zipper teeth 3 may be slightly different). As shown in FIG. 1, FIG. 2, FIG. 3 and FIG. 4, the right zipper tooth 3 includes an upper tooth part 31 and a lower tooth part 32, and process fillets 30 are still formed at corner parts of the right zipper tooth 3. When the right zipper tooth 3 is made from a resin material, the right zipper tooth 3 is usually positioned on the inner side of the right zipper cloth tape 1*b* by virtue of a processing process of hot melting and the like, and then a connected part of the right zipper tooth 3 and the zipper cloth tape 1*b* is a connecting part 33.

The whole outer combined lateral surface 4 forms a smoothly-transitioned inclined surface.

Figure 4:
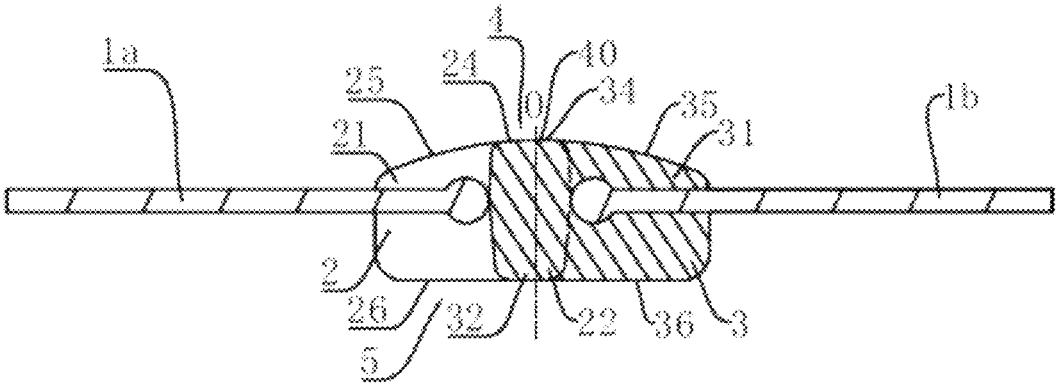
FIG. 4 is a sectional structure diagram in an A-A direction in FIG. 1 as well as a structure diagram of a first implementation mode of an outer combined lateral surface, wherein the highest point of the outer combined lateral surface is at a central axis 0.

Wherein, the first specific structure forming the smoothly-transitioned inclined surface is as shown in FIG. 4, and outer lateral surfaces of the upper tooth parts 31 of the right zipper teeth 3 include outwards-raised cambered connecting part outer lateral surfaces 35 and outwards-raised cambered tooth part outer lateral surfaces 34; and inner lateral surfaces of the lower tooth parts 32 are straight bottom surfaces 36. Similarly, the left zipper teeth 2 are also provided with upper tooth parts 21 and lower tooth parts 22, and outer lateral surfaces of the left zipper teeth 2 also include outwards-raised cambered connecting part outer lateral surfaces 25 and outwards-raised cambered tooth part outer lateral surfaces 24; and inner lateral surfaces of the lower tooth parts 22 are straight bottom surfaces 26. As shown in FIG. 4, the right zipper teeth 3 are connected with the left zipper teeth 2 through the lower tooth parts 32 and the lower tooth parts 22 in a fastening manner, and the upper tooth parts 31 of the right zipper teeth 3 and the upper tooth parts 21 of the left zipper teeth 2 are arranged on front and back in a mutual insertion and combination manner.

FIG. 4 is a sectional structure diagram in an A-A direction in FIG. 1, i.e. a cross-sectional view of the left zipper teeth 2 and right zipper teeth 3 in a fastened state, wherein the cross section is a section cut along a direction perpendicular to the axial direction. After the zipper is sewn to the garment, the outer combined lateral surface 4 formed by the outer lateral surfaces (35, 34) of the upper tooth parts 31 and the outer lateral surfaces (25, 24) of the upper tooth parts (21) is arranged outside the garment, and on the contrary, the inner combined lateral surface 5 of the left zipper teeth 2 and the right zipper teeth 3 is hidden in the garment. According to a first implementation mode, the whole outer combined lateral surface 4 forms a smoothly-transitioned outwards-raised cambered surface, and specifically, the outer combined lateral surface 4 includes the outwards-raised cambered connecting part outer lateral surfaces 25 and outwards-raised cambered tooth part outer lateral surfaces 24 of the left zipper teeth 2, and also includes the outwards-raised cambered connecting part outer lateral surfaces 35 and outwards-raised cambered tooth part outer lateral surfaces 34 of the right zipper teeth 3, wherein the tooth part outer lateral surfaces 24 and the tooth part outer lateral surfaces 34 are overlapped on front and back to form a cambered transition surface 40 on the cross-sectional view, and the transition surface 40 is arranged on the two sides of the central axis 0 between the right zipper teeth 3 and the left zipper teeth 2.

Figure 5:
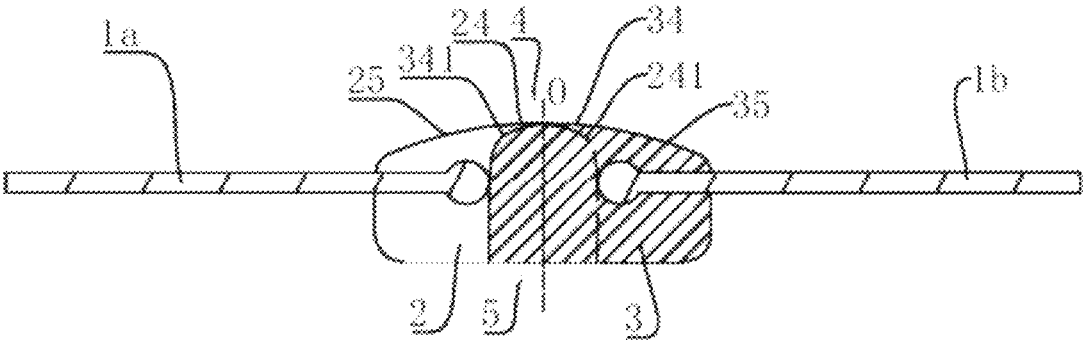
FIG. 5 is a structure diagram of a second implementation mode of an outer combined lateral surface improved on the basis of the first implementation mode.

There is also a second implementation mode, and in order to present the cambered outer combined lateral surface 4, as shown in FIG. 5, head parts 241 of the tooth part outer lateral surfaces 24 of the left zipper teeth 2 on the right side of the central axis 0 can be slightly lowered from the central axis 0, that is, the head parts 241 are not positioned on the cambered surface defined by the outer combined lateral surface 4; head parts 341 of the tooth part outer lateral surfaces 34 of the right zipper teeth 3 on the left side of the central axis can be lowered from the central axis 0; and in such a manner, the whole outer combined lateral surface 4 is still substantially cambered on the cross section.

Figure 6:
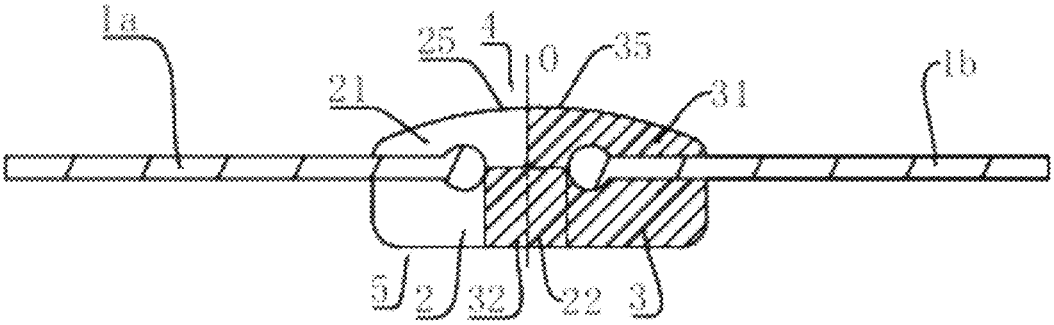
FIG. 6 is a structure diagram of a third implementation mode of an outer combined lateral surface improved on the basis of the first implementation mode.

In addition, if there are no mutually inserted structures but bilaterally arranged structures between the upper tooth parts 31 of the right zipper teeth 3 and the upper tooth parts 21 of the left zipper teeth 2, like the structure diagram of a third implementation mode shown in FIG. 6, the upper tooth parts 31 of the right zipper teeth 3 and the upper tooth parts 21 of the left zipper teeth 2 can only extend to the vicinity of the central axis 0, and although certain distances may be formed between the upper tooth parts 31 of the right zipper teeth 3 and the upper tooth parts 21 of the left zipper teeth 2, the whole outer combined lateral surface 4 is still substantially cambered on the cross section.

Figure 7:
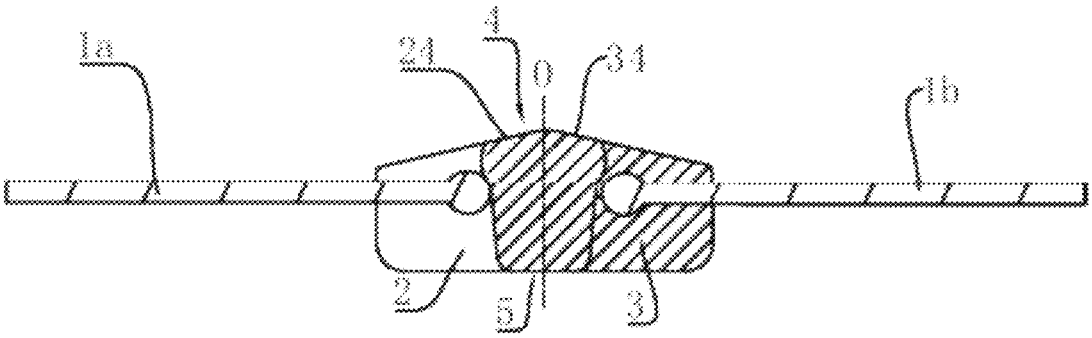
FIG. 7 is a structure diagram of a fourth implementation mode of an outer combined lateral surface.

According to a fourth implementation mode of the outer combined lateral surface 4 as shown in FIG. 7, the two sides of the central axis 0 are straight inclined surfaces (24, 34), the inclined surfaces (24, 34) form a herringbone structure, and a top of the herringbone structure forms transitional connection through a transition circular arc.

Figure 8:
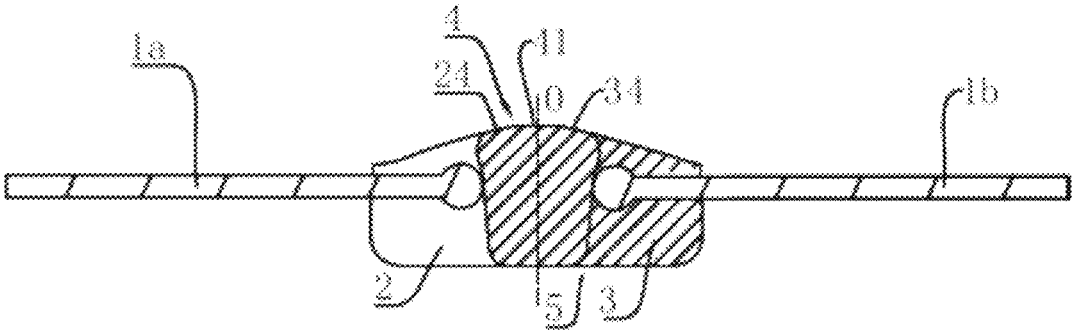
FIG. 8 is a structure diagram of a fifth implementation mode of an outer combined lateral surface.

According to a fifth implementation mode of the outer combined lateral surface 4 as shown in FIG. 8, on the basis of the first implementation mode, a small platform part 41 is arranged at a position where the central axis 0 is located, and the platform part 41 is in smooth transition connection with the tooth part outer lateral surfaces 24 and tooth part outer lateral surfaces 34 on the two sides.

Figure 9:
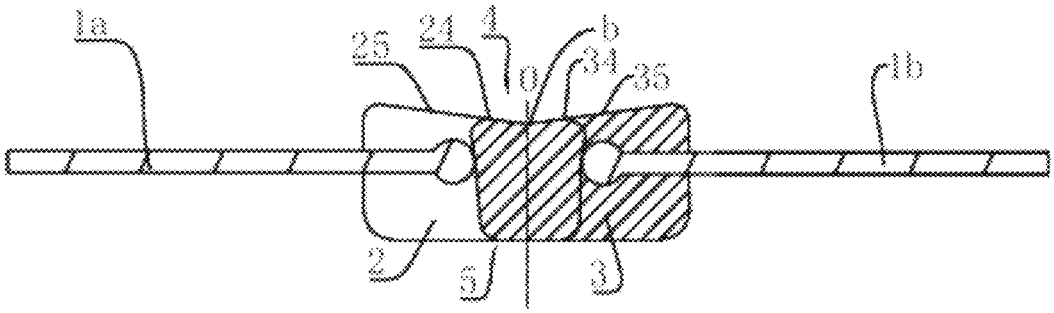
FIG. 9 is a structure diagram of a sixth implementation mode of an outer combined lateral surface.
Figure 10:
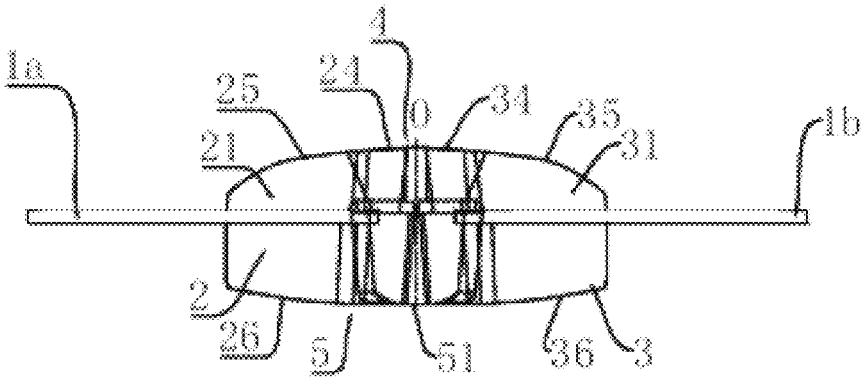
FIG. 10 is a structure diagram of a smoothly-transitioned inclined surface of an inner combined lateral surface.

According to a sixth implementation mode of the outer combined lateral surface 4 as shown in FIG. 9, a difference with the first implementation mode is that the whole outer combined lateral surface 4 is shaped like a concave camber, and transition is formed between positions at the two ends of the concave camber through a circular arc. In such a structure, a central part is thinner, so that the central part can be directly provided with mutually fastened tooth parts.

As shown in FIG. 10, a combined zipper tooth with an inner combined lateral surface 5 which integrally forms a smoothly-transitioned inclined surface structure is further disclosed. Wherein, a difference with contents shown in FIG. 4 is that the whole inner combined lateral surface 5 is also a smoothly-transitioned inclined surface, a platform part 51 is arranged in a central area of the inner combined lateral surface 5, and the platform part 51 is in smooth transition with inclined surfaces (26, 36) on the two sides.

Figure 11:
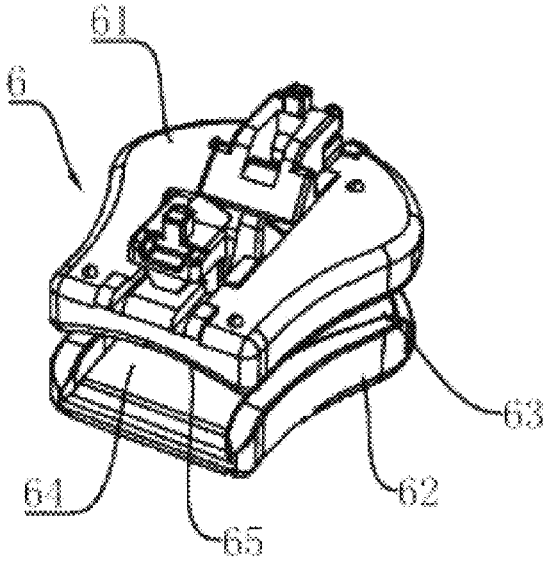
FIG. 11 is a structure diagram of a puller matched with zipper teeth shown in FIG. 4 to FIG. 9 for use.
Figure 12:
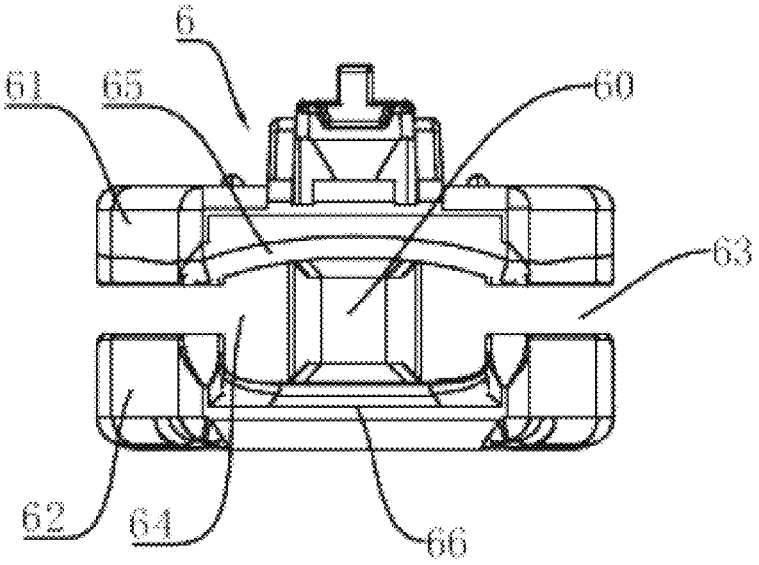
FIG. 12 is a structure diagram of a puller matched with zipper teeth shown in FIG. 10 for use.

A puller 6 for the zipper shown in FIG. 4 to FIG. 9 is further included, and as shown in FIG. 11, includes an upper cover plate 61, a lower cover plate 62 and a middle connecting column (covered and not shown in FIG. 11), wherein side slots 63 through which the zipper teeth pass, a zipper tooth inlet and a zipper tooth outlet are formed between the upper cover plate 61 and the lower cover plate 62, zipper tooth inlet end parts 64 are arranged at the front end of the puller 6, and tooth zipper outlet end parts are arranged at its tail end; and the upper cover plate 61 is provided with an inner lateral surface 65 adapted to the outer combined lateral surface 4 close to the zipper tooth inlet end part 64. Therefore, the inner lateral surface of the zipper tooth inlet end part 64 is a smoothly-transitioned inclined surface, and other inner lateral surfaces of the upper cover plate 61 may also be smoothly-transitioned inclined surfaces.

A puller 6 for the zipper shown in FIG. 10 is further included, and as shown in FIG. 11, includes an upper cover plate 61, a lower cover plate 62 and a middle connecting column 60, wherein side slots 63 through which the zipper teeth pass, a zipper tooth inlet and a zipper tooth outlet are formed between the upper cover plate 61 and the lower cover plate 62, zipper tooth inlet end parts 64 are arranged at the front end of the puller 6, and tooth zipper outlet end parts (covered and not shown in FIG. 11) are arranged at its tail end; the upper cover plate 61 is provided with an inner lateral surface 65 adapted to the outer combined lateral surface 4 close to the zipper tooth inlet end part 64, and the lower cover plate 62 is provided with an inner lateral surface 66 adapted to the inner combined lateral surface 5 close to the zipper tooth inlet end part 64. Therefore, inner lateral surfaces (65, 66) of the zipper tooth inlet end part 64 are smoothly-transitioned inclined surfaces, and other inner lateral surfaces of the upper cover plate 61 and the lower cover plate 62 may also be smoothly-transitioned inclined surfaces.

What is claimed is:

1. A zipper, comprising:

a pair of zipper cloth tapes extending along an axial direction; and a plurality of zipper teeth arranged on opposite inner sides of the pair of zipper cloth tapes and operable to be mutually fastened;

wherein each of the plurality of zipper teeth comprises an upper tooth part and a lower tooth part;

the upper tooth part of each of the zipper teeth comprises an outer lateral surface; and respective outer lateral surfaces of the zipper teeth opposite to each other forms an outer combined lateral surface after the opposite zipper teeth are fastened;

wherein from a cross section perpendicular to the axial direction, the outer combined lateral surface forms a smooth arcuate-shaped surface; and a middle line between the opposite zipper teeth defines a central axis, and a highest point of the outer combined lateral surface is located on the central axis; and wherein the lower tooth part of each of the zipper teeth comprises a bottom surface; and respective bottom surfaces of the opposite zipper teeth forms an inner combined lateral surface after the opposite zipper teeth are fastened.

2. The zipper of claim 1, wherein from the cross section, the bottom surface of the lower tooth part is straight.

3. A zipper, comprising:

a pair of zipper cloth tapes extending along an axial direction; and a plurality of zipper teeth arranged on opposite inner sides of the pair of zipper cloth tapes and operable to be mutually fastened;

wherein each of the plurality of zipper teeth comprises an upper tooth part and a lower tooth part;

the upper tooth part of each of the zipper teeth comprises an outer lateral surface; and respective outer lateral surfaces of the zipper teeth opposite to each other forms an outer combined lateral surface after the opposite zipper teeth are fastened;

wherein from a cross section perpendicular to the axial direction, the outer combined lateral surface forms a smooth arcuate-shaped surface; and a middle line between the opposite zipper teeth defines a central axis, and a highest point of the outer combined lateral surface is located on the central axis; and wherein the opposite zipper teeth are fastened through engagement of respective lower tooth parts of the opposite zipper teeth.

4. The zipper of claim 3, wherein the upper tooth parts of the opposite zipper teeth are arranged in an alternate manner after the opposite zipper teeth are fastened.

5. A zipper, comprising:

a pair of zipper cloth tapes extending along an axial direction; and a plurality of zipper teeth arranged on opposite inner sides of the pair of zipper cloth tapes and operable to be mutually fastened;

wherein each of the plurality of zipper teeth comprises an upper tooth part and a lower tooth part;

the upper tooth part of each of the zipper teeth comprises an outer lateral surface;

and respective outer lateral surfaces of the zipper teeth opposite to each other forms an outer combined lateral surface after the opposite zipper teeth are fastened;

wherein from a cross section perpendicular to the axial direction, the outer combined lateral surface forms a smooth arcuate-shaped surface; and a middle line between the opposite zipper teeth defines a central axis, and a highest point of the outer combined lateral surface is located on the central axis; and wherein the zipper teeth are made from a resin material.

6. The zipper of claim 1, wherein the outer lateral surface of the upper tooth part of each of the zipper teeth comprises a first outer lateral surface close to the central axis, and a second outer lateral surface away from the central axis; and respect first outer lateral surfaces of the opposite zipper teeth form a cambered transition surface.

7. The zipper of claim 1, wherein each of the zipper teeth further comprises a connecting part at which the pair of zipper cloth tapes and the zipper teeth are connected.

8. The zipper of claim 1, further comprising a puller for unfastening and fastening the left and right zipper teeth;

wherein the puller comprises an upper cover plate, a lower cover plate and a middle connecting column; side slots through which the zipper teeth pass, a zipper tooth inlet and a zipper tooth outlet are formed between the upper cover plate and the lower cover plate; zipper tooth inlet end parts are arranged at the front end of the puller, and zipper tooth outlet end parts are arranged at its tail end; and the zipper tooth inlet end part of the upper cover plate has an inner lateral surface adapted to the outer combined lateral surface.

9. The zipper of claim 3, wherein the outer lateral surface of the upper tooth part of each of the zipper teeth comprises a first outer lateral surface close to the central axis, and a second outer lateral surface away from the central axis; and respect first outer lateral surfaces of the opposite zipper teeth form a cambered transition surface.

10. The zipper of claim 3, wherein each of the zipper teeth further comprises a connecting part at which the pair of zipper cloth tapes and the zipper teeth are connected.

11. The zipper of claim 3, further comprising a puller for unfastening and fastening the left and right zipper teeth;

wherein the puller comprises an upper cover plate, a lower cover plate and a middle connecting column; side slots through which the zipper teeth pass, a zipper tooth inlet and a zipper tooth outlet are formed between the upper cover plate and the lower cover plate; zipper tooth inlet end parts are arranged at the front end of the puller, and zipper tooth outlet end parts are arranged at its tail end; and the zipper tooth inlet end part of the upper cover plate has an inner lateral surface adapted to the outer combined lateral surface.

12. The zipper of claim 5, wherein the outer lateral surface of the upper tooth part of each of the zipper teeth comprises a first outer lateral surface close to the central axis, and a second outer lateral surface away from the central axis; and respect first outer lateral surfaces of the opposite zipper teeth form a cambered transition surface.

13. The zipper of claim 5, wherein each of the zipper teeth further comprises a connecting part at which the pair of zipper cloth tapes and the zipper teeth are connected.

14. The zipper of claim 5, further comprising a puller for unfastening and fastening the left and right zipper teeth;

wherein the puller comprises an upper cover plate, a lower cover plate and a middle connecting column; side slots through which the zipper teeth pass, a zipper tooth inlet and a zipper tooth outlet are formed between the upper cover plate and the lower cover plate; zipper tooth inlet end parts are arranged at the front end of the puller, and zipper tooth outlet end parts are arranged at its tail end; and the zipper tooth inlet end part of the upper cover plate has an inner lateral surface adapted to the outer combined lateral surface.

* * * * *